US011725674B2

(12) United States Patent
Muraoka et al.

(10) Patent No.: US 11,725,674 B2
(45) Date of Patent: Aug. 15, 2023

(54) HYDRAULIC SYSTEM

(71) Applicant: KAWASAKI JUKOGYO KABUSHIKI KAISHA, Kobe (JP)

(72) Inventors: Hideyasu Muraoka, Kobe (JP); Nobuyuki Kinoshita, Kobe (JP); Akihiro Kondo, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/594,880

(22) PCT Filed: Apr. 7, 2020

(86) PCT No.: PCT/JP2020/015737
§ 371 (c)(1),
(2) Date: Nov. 2, 2021

(87) PCT Pub. No.: WO2020/235242
PCT Pub. Date: Nov. 26, 2020

(65) Prior Publication Data

US 2022/0205464 A1 Jun. 30, 2022

(30) Foreign Application Priority Data

May 22, 2019 (JP) ..... 2019-095808

(51) Int. Cl.

| | |
|---|---|
| ***F15B 13/044*** | (2006.01) |
| ***F15B 13/02*** | (2006.01) |
| ***F15B 15/18*** | (2006.01) |
| ***F15B 20/00*** | (2006.01) |

(52) U.S. Cl.
CPC ..... *F15B 13/044* (2013.01); *F15B 13/025* (2013.01); *F15B 15/18* (2013.01); *F15B 20/00* (2013.01)

(58) Field of Classification Search
CPC ..... F15B 13/043; F15B 13/0433; F15B 2211/329; F15B 2211/355
See application file for complete search history.

(56) References Cited

U.S. PATENT DOCUMENTS

| | | | | |
|---|---|---|---|---|
| 9,500,292 | B2 * | 11/2016 | Ravn | F16K 31/12 |
| 11,125,254 | B2 * | 9/2021 | Erikksson | F15B 11/10 |
| 2015/0377375 | A1 * | 12/2015 | Takagi | F16K 31/0613 137/242 |

(Continued)

FOREIGN PATENT DOCUMENTS

| | | |
|---|---|---|
| CN | 107701720 A | 2/2018 |
| CN | 108286542 A | 7/2018 |

(Continued)

*Primary Examiner* — Thomas E Lazo
(74) *Attorney, Agent, or Firm* — Alleman Hall Creasman & Tuttle LLP

(57) ABSTRACT

A hydraulic system includes: a solenoid valve that includes a valve spool configured to slide within a housing, and moves the valve spool to a position corresponding to an operation command input to the solenoid valve; and a control device that outputs the operation command to the solenoid valve. When a predetermined condition is satisfied, the control device outputs a continuously or intermittently changing operation command to the solenoid valve to reciprocate the valve spool from a full open position or a full closed position.

9 Claims, 5 Drawing Sheets

(56) References Cited

U.S. PATENT DOCUMENTS

| | | | | |
|---|---|---|---|---|
| 2017/0166253 | A1* | 6/2017 | Kondo | E02F 9/2267 |
| 2017/0342685 | A1 | 11/2017 | Kondo et al. | |
| 2019/0100900 | A1* | 4/2019 | Fukuda | E02F 9/2235 |

FOREIGN PATENT DOCUMENTS

| | | | | | |
|---|---|---|---|---|---|
| CN | 108779791 | A | * | 11/2018 | B66C 13/20 |
| JP | 2006308073 | A | * | 11/2006 | |
| JP | 2006308073 | A | | 11/2006 | |
| JP | 2016011680 | A | | 1/2016 | |
| JP | 2016109271 | A | | 6/2016 | |

* cited by examiner

HYDRAULIC SYSTEM

TECHNICAL FIELD

The present invention relates to a hydraulic system that electronically controls operation of a solenoid valve by a control device.

BACKGROUND ART

A hydraulic system that operates a multi-control valve using a solenoid valve is known, and one example thereof is a hydraulic drive system disclosed in Patent Literature (PTL 1). The hydraulic drive system disclosed in PTL 1 includes a turning control valve (multi-control valve) and controls the flow of operating oil for a turning motor by changing the position of a spool of the turning control valve according to a pilot pressure output from a solenoid valve.

CITATION LIST

Patent Literature

PTL 1: Japanese Laid-Open Patent Application Publication No. 2016-109271

SUMMARY OF INVENTION

Technical Problem

The solenoid valve used in the hydraulic drive system disclosed in PTL 1 is configured as follows, for example. Specifically, in the solenoid valve, the spool is slidably inserted through a housing, and the spool moves under thrust from a solenoid. By movement of the spool, the solenoid valve changes the pilot pressure to be output, and changes the position of the spool of the turning control valve. The solenoid valve moves the spool by the solenoid in this manner, but the thrust from the solenoid is not great. Therefore, there is a risk of malfunctions due to clogging with contaminants such as dust, pieces of metal, and fiber dust that are caught in a gap between the housing and the spool, resulting in sticking, etc., of the spool or a closing failure due to the contaminants being stuck in a metering portion (for example, a notch) of the spool. Regarding this issue, it is conceivable to provide more than one filter in an oil passage leading to the solenoid valve and catch the contaminants, but this may not always be an effective measure.

Thus, an object of the present invention is to provide a hydraulic system with which the occurrence of malfunctions of a solenoid valve due to contaminants can be reduced.

Solution to Problem

A hydraulic system according to the first invention includes: a solenoid valve that includes a valve spool configured to slide within a housing, and moves the valve spool according to an operation command input to the solenoid valve; and a control device that outputs the operation command to the solenoid valve. When a condition predetermined is satisfied, the control device outputs the operation command to the solenoid valve to reciprocate the valve spool from a full open position or a full closed position.

According to the present invention, it is possible to intentionally reciprocate the valve spool from the full open position or the full closed position by satisfying the predetermined condition. Thus, it is possible to clean the solenoid valve by removing contaminants or the like caught in a gap between the valve spool and the housing, allowing a reduction in the occurrence of operational malfunctions of the solenoid valve caused by the contaminants.

In the above-described invention, it is preferable that the solenoid valve be a solenoid switch valve, the operation command include an open command to place the valve spool in the full open position and a close command to place the valve spool in the full closed position, and when the condition is satisfied, the control device reverse the operation command that is one of the open command and the close command to be continuously output to the solenoid switch valve into the other for a predetermined short amount of time and reciprocate the valve spool.

According to this configuration, it is possible to clean the solenoid switch valve by removing contaminants or the like caught in a gap between the valve spool and the housing.

In the above-described invention, it is preferable that the solenoid valve be a solenoid proportional pressure-reducing valve, the operation command include a predetermined command to place the valve spool in the full open position or the full closed position, and when the condition is satisfied, the control device change the predetermined command that is continuously output to the solenoid proportional pressure-reducing valve into a specific operation command for a predetermined amount of time and reciprocate the valve spool.

According to this configuration, it is possible to clean the solenoid proportional pressure-reducing valve by removing contaminants or the like caught in a gap between the valve spool and the housing.

In the above-described invention, it is preferable that a pair of the solenoid valves be included, the pair of the solenoid valves be each a solenoid proportional pressure-reducing valve and be disposed to exert secondary pressures output from the pair of the solenoid valves on a control spool of a control valve toward each other, the operation command include a predetermined command to place the valve spool in the full open position or the full closed position, and when the condition is satisfied, the control device change the predetermined command that is continuously output to the solenoid proportional pressure-reducing valve into a specific operation command for a predetermined amount of time, equalize the secondary pressures at the pair of the solenoid proportional pressure-reducing valves, and reciprocate the valve spool.

According to this configuration, without moving the control spool of the control valve, it is possible to clean the pair of solenoid proportional pressure-reducing valves by removing contaminants or the like caught in a gap between the valve spool and the housing.

In the above-described invention, it is preferable that a switch valve be included which is provided upstream of the solenoid proportional pressure-reducing valve and is capable of blocking a flow of operating oil directed to the solenoid proportional pressure-reducing valve and the condition include a condition in which the flow of the operating oil directed to the solenoid valve is blocked by the switch valve.

According to this configuration, the valve spool of the solenoid proportional pressure-reducing valve can be reciprocated in the state in which no pressure oil is supplied to the solenoid proportional pressure-reducing valve, and thus it is possible to reduce the occurrence of an undesired pilot pressure being output from the solenoid proportional pressure-reducing valve during the reciprocating movement.

In the above-described invention, it is preferable that the solenoid valve be a solenoid proportional pressure-reducing valve and be disposed to exert a secondary pressure output from the solenoid proportional pressure-reducing valve on a control spool of a control valve, the control valve include a dead band in which the control valve does not operate when the secondary pressure is less than a predetermined value, and the control device adjust the operation command that is output to reciprocate the valve spool, to make the secondary pressure to be output from the solenoid proportional pressure-reducing valve less than a predetermined value.

According to this configuration, it is possible to reciprocate a valve spool of the solenoid valve without moving the control spool of the control valve. Therefore, undesired movement of the control spool of the control valve during the reciprocating movement can be minimized.

In the above-described invention, it is preferable that the control device output a step-wise operation command to the solenoid proportional pressure-reducing valve to reciprocate the valve spool.

According to this configuration, it is possible to reciprocate the valve spool with a greater magnetic force, and thus the spool can be moved even when some contaminants stick thereto. This makes it possible to achieve higher cleaning effects.

In the above-described invention, it is preferable that the condition include a condition in which a hydraulic pressure is kept from flowing downstream of the solenoid valve.

According to this configuration, it is possible to reduce the occurrence of an undesired moving hydraulic pressure being output to the downstream side of the solenoid valve during the reciprocating movement of the spool.

In the above-described invention, it is preferable that a pressure sensor be further included which is provided downstream of the solenoid valve, and the control device detect an operational malfunction of the valve spool on the basis of a pressure detected by the pressure sensor and the operation command that is output to the solenoid valve.

According to this configuration, the hydraulic system can detect mechanical, operational malfunctions such as sticking of the spool.

A hydraulic system according to the second invention includes: a pilot pump that dispenses pilot oil; a solenoid proportional pressure-reducing valve connected to the pilot pump via a pilot passage and configured to output a secondary pressure corresponding to a pressure-reducing command input to the solenoid proportional pressure-reducing valve; a control valve that controls, according to the secondary pressure output from the solenoid proportional pressure-reducing valve, a flow of pressure oil flowing to a hydraulic actuator; a solenoid switch valve provided in the pilot passage and configured to block the pilot passage according to a switching command input to the solenoid switch valve; and a control device that outputs the pressure-reducing command to the solenoid proportional pressure-reducing valve and outputs the switching command to the solenoid switch valve. The solenoid switch valve includes a first valve spool configured to slide within a first housing, and blocks the pilot passage by moving the first valve spool according to the switching command input to the solenoid switch valve. The solenoid proportional pressure-reducing valve includes a second valve spool configured to slide within a second housing, and adjusts the secondary pressure to be output, by moving the second valve spool according to the pressure-reducing command input to the solenoid proportional pressure-reducing valve. When a first condition predetermined is satisfied, the control device outputs the switching command to the solenoid switch valve to reciprocate the first valve spool from a full open position or a full closed position, and when a second condition predetermined is satisfied, the control device outputs the pressure-reducing command to the solenoid proportional pressure-reducing valve to reciprocate the second valve spool from a full open position or a full closed position.

According to this configuration, by satisfying the first and second conditions, it is possible to intentionally reciprocate the respective valve spools of the solenoid proportional pressure-reducing valve and the solenoid switch valve from the full open position or a full closed position, and thus contaminants or the like caught in a gap between each valve spool and the housing can be removed. Therefore, the occurrence of operational malfunctions at the solenoid proportional pressure-reducing valve and the solenoid switch valve due to the contaminants can be minimized.

In the above-described invention, it is preferable that the switching command include an open command to place the first valve spool in the full open position and a close command to place the first valve spool in the full closed position, the pressure-reducing command include a predetermined command to place the second valve spool in the full open position or the full closed position, and when the first condition is satisfied, the control device reverse an operation command that is one of the open command and the close command to be continuously output to the solenoid switch valve into the other for a first predetermined short amount of time and reciprocate the first valve spool, and when the second condition is satisfied, the control device change the predetermined command that is continuously output to the solenoid proportional pressure-reducing valve into a specific operation command for a second predetermined amount of time and reciprocate the second valve spool.

According to this configuration, it is possible to intentionally reciprocate the valve spool of each of the solenoid proportional pressure-reducing valve and the solenoid switch valve from the full open position or the full closed position, and cleaning for removing contaminants or the like caught in a gap between each valve spool and the housing can be carried out. It is possible to clean the solenoid proportional pressure-reducing valve by removing contaminants or the like caught in a gap between the valve spool and the housing.

In the above-described invention, it is preferable that a pair of the solenoid proportional pressure-reducing valves be included, the control valve include a control spool and control, according to a position of the control spool, the flow of the pressure oil flowing to the hydraulic actuator, the pair of the solenoid proportional pressure-reducing valves move the control spool by exerting secondary pressures output from the pair of the solenoid proportional pressure-reducing valves on the control spool toward each other, the switching command include an open command to place the first valve spool in the full open position and a close command to place the first valve spool in the full closed position, the pressure-reducing command include a predetermined command to place the second valve spool in the full open position or the full closed position, and when the first condition is satisfied, the control device reverse an operation command that is one of the open command and the close command to be continuously output to the solenoid switch valve into the other for a first predetermined short amount of time and reciprocate the first valve spool, and when the second condition is satisfied, the control device change the predetermined command that is continuously output to the solenoid proportional pressure-reducing valve into a specific pressure-reducing command for a second predetermined amount of time, equalize the secondary pressures at the pair of the solenoid proportional pressure-reducing valves, and reciprocate the second valve spool.

According to this configuration, it is possible to intentionally reciprocate the valve spool of each of the solenoid proportional pressure-reducing valve and the solenoid switch valve from the full open position or the full closed position, and cleaning for removing contaminants or the like caught in a gap between each valve spool and the housing can be carried out. It is possible to clean the solenoid proportional pressure-reducing valve by removing contaminants or the like caught in a gap between the valve spool and the housing. Furthermore, regarding the pair of solenoid proportional pressure-reducing valve, without moving the control spool of the control valve, it is possible to clean the pair of solenoid proportional pressure-reducing valve by removing contaminants or the like caught in a gap between the valve spool and the housing.

In the above-described invention, it is preferable that the control valve include a dead band in which the control valve does not operate when the secondary pressure is less than a predetermined value, and the first condition include a condition in which the pressure-reducing command to make the secondary pressure to be output from the solenoid proportional pressure-reducing valve less than the predetermined value has been output.

According to this configuration, it is possible to reciprocate the first valve spool of the solenoid switch valve without moving the control spool of the control valve. Therefore, undesired movement of the control spool of the control valve during the reciprocating movement can be minimized.

In the above-described invention, it is preferable that the second condition include a condition in which the pilot passage is blocked by the solenoid switch valve.

According to this configuration, the valve spool of the solenoid proportional pressure-reducing valve can be reciprocated in the state in which no pressure oil is supplied to the solenoid proportional pressure-reducing valve, and thus it is possible to minimize undesired movement of the control valve that results from output of an undesired pilot pressure from the solenoid proportional pressure-reducing valve during the reciprocating movement.

In the above-described invention, it is preferable that at least one of the first condition and the second condition include a condition in which the pilot pump is not operating.

According to this configuration, it is possible to minimize undesired movement of the control valve that results from output of an undesired pilot pressure from the solenoid proportional pressure-reducing valve during the reciprocating movement of the valve spool.

Advantageous Effects of Invention

With the present invention, it is possible to reduce the occurrence of contaminant-caused operational malfunctions at a solenoid valve.

The above object, other objects, features, and advantages of the present invention will be made clear by the following detailed explanation of preferred embodiments with reference to the attached drawings.

DESCRIPTION OF EMBODIMENTS

Figure 1:
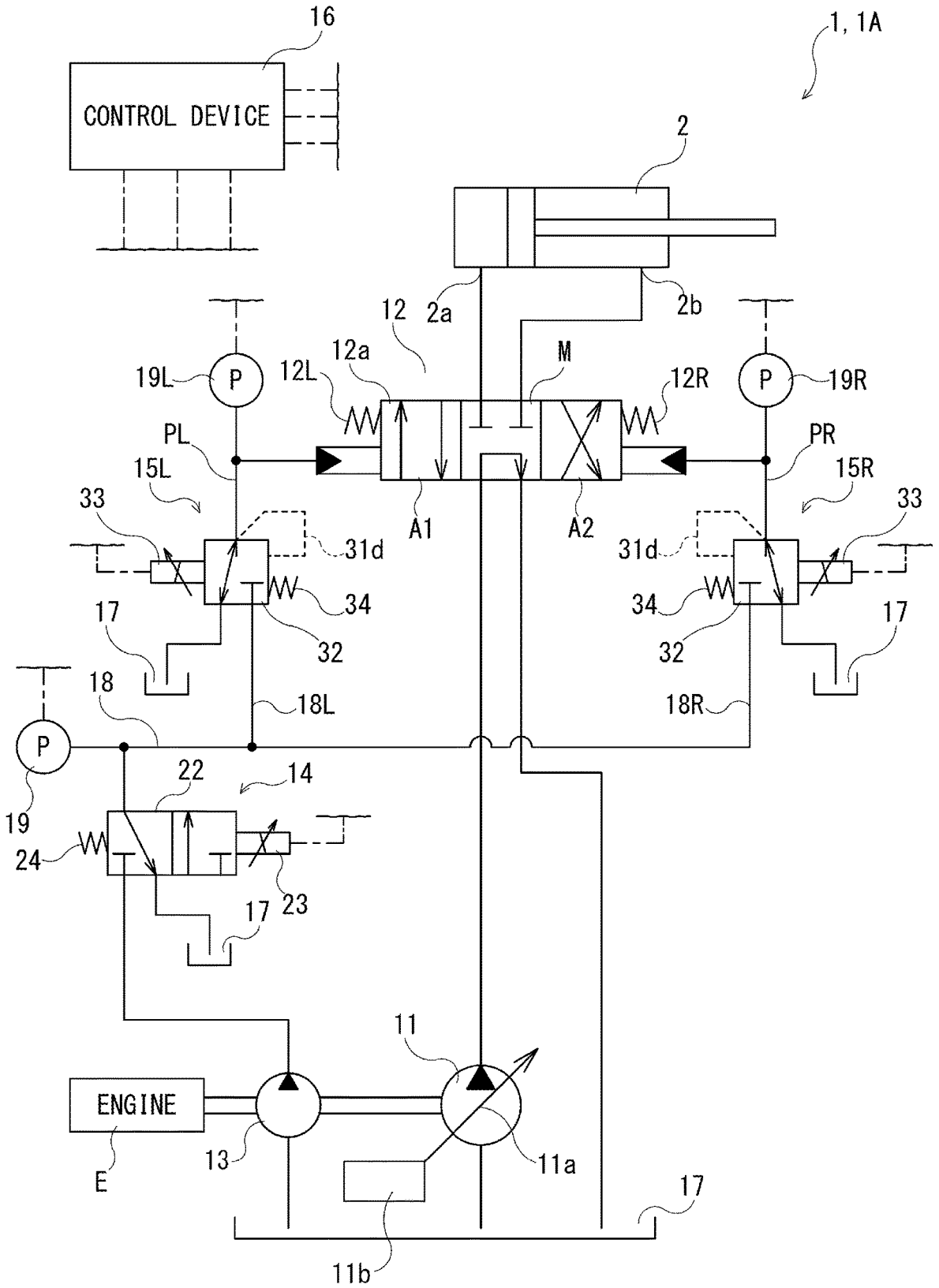
FIG. 1 is a hydraulic circuit diagram illustrating the configuration of a hydraulic system according to each of Embodiments 1, 2 of the present invention.

Hereinafter, hydraulic systems 1, 1A according to Embodiments 1, 2 of the present invention will be described with reference to the aforementioned drawings. Note that the concept of directions mentioned in the following description is used for the sake of explanation and is not intended to limit the orientations, etc., of elements according to the present invention to these directions. The hydraulic systems 1, 1A described below are merely one embodiment of the present invention. Thus, the present invention is not limited to the embodiments and may be subject to addition, deletion, and alteration within the scope of the essence of the present invention.

Embodiment 1

Vehicles including industrial vehicles and construction vehicles and equipment including industrial equipment and construction equipment (hereinafter referred to simply as "vehicles, etc.") include a hydraulic actuator (for example, a hydraulic cylinder and a hydraulic motor) 2 and can perform various operations by moving the hydraulic actuator 2. Such vehicles, etc., include a hydraulic system 1 to supply operating oil to the hydraulic actuator 2 and move the hydraulic actuator 2; the hydraulic system 1 according to the present embodiment includes a hydraulic excavator, for example. The hydraulic system 1 supplies the operating oil to the double-acting hydraulic cylinder 2 included in the hydraulic excavator, for example. Note that the vehicle to which the hydraulic system 1 is applied is not limited to the hydraulic excavator, and the hydraulic actuator 2 is not limited to the double-acting hydraulic cylinder 2. The hydraulic actuator 2 may be a single-acting hydraulic cylinder or hydraulic motor. Next, the hydraulic system 1 will be described.

The hydraulic system 1 includes a main pump 11, a multi-control valve 12, a pilot pump 13, a safety lock valve 14, a solenoid proportional pressure-reducing valves 15L, 15R, and a control device 16. The main pump 11 is, for example, a swash plate pump of the variable capacitance type and is coupled to an engine E. Note that the main pump 11 is not limited to the swash plate pump and may be a bent axis pump of the variable capacitance type. The main pump 11 is driven to rotate by the engine E and when driven to rotate, dispenses the operating oil. The operating oil is dispensed at a flow rate corresponding to the tilt angle of a swash plate 11*a*, and a regulator 11*b* changes the tilt angle of the swash plate 11*a*. The operating oil dispensed in this manner is guided to the multi-control valve 12.

The multi-control valve 12, which is what is called a directional control valve, switches, by moving a spool 12*a*, a direction in which the operating oil flows. More specifically, the multi-control valve 12 is connected to a head-end port 2*a* and a rod-end port 2*b* of the hydraulic cylinder 2 and a tank 17 in addition to a main pump 11, and switches the connection state of each of these elements according to the position of the spool 12*a*. Specifically, when the pool 12*a*, which is one example of the control spool, moves from a neutral position M to a first offset position A1, the main pump 11 is connected to the head-end port 2*a*, the rod-end port 2*b* is connected to the tank 17, and the hydraulic cylinder 2 is extended. On the other hand, when the spool 12*a* moves from the neutral position M to a second offset position A2, the main pump 11 is connected to the rod-end port 2*b* and the head-end port 2*a* is connected to the tank 17, and the hydraulic cylinder 2 is retracted. Furthermore, when the spool 12*a* returns to the neutral position M, the two ports 2*a*, 2*b* are disconnected from the main pump 11, the extension and retraction of the hydraulic cylinder 2 stop, and thus the hydraulic cylinder 2 can be held in that position.

Furthermore, two spring members 12L, 12R bias the spool 12*a* toward each other, and moreover two pilot pressures PL, PR opposing each other and opposing the biasing forces of the spring members 12L, 12R act on the spool 12*a*. Therefore, the spool 12*a* moves to a position in which the two biasing forces and the two pilot pressures PL, PR are in balance, allowing the operating oil to flow to the hydraulic cylinder 2 in a direction and at a flow rate (in other words, the flow) that correspond to the position of the spool 12*a*. In other words, by adjusting the two pilot pressures PL, PR, the hydraulic cylinder 2 is switched between extension and retraction, and the speed thereof is controlled. Furthermore, the hydraulic system 1 includes a pilot pump 13 in order to provide the pilot pressures PL, PR to the spool 12*a*.

Figure 2:
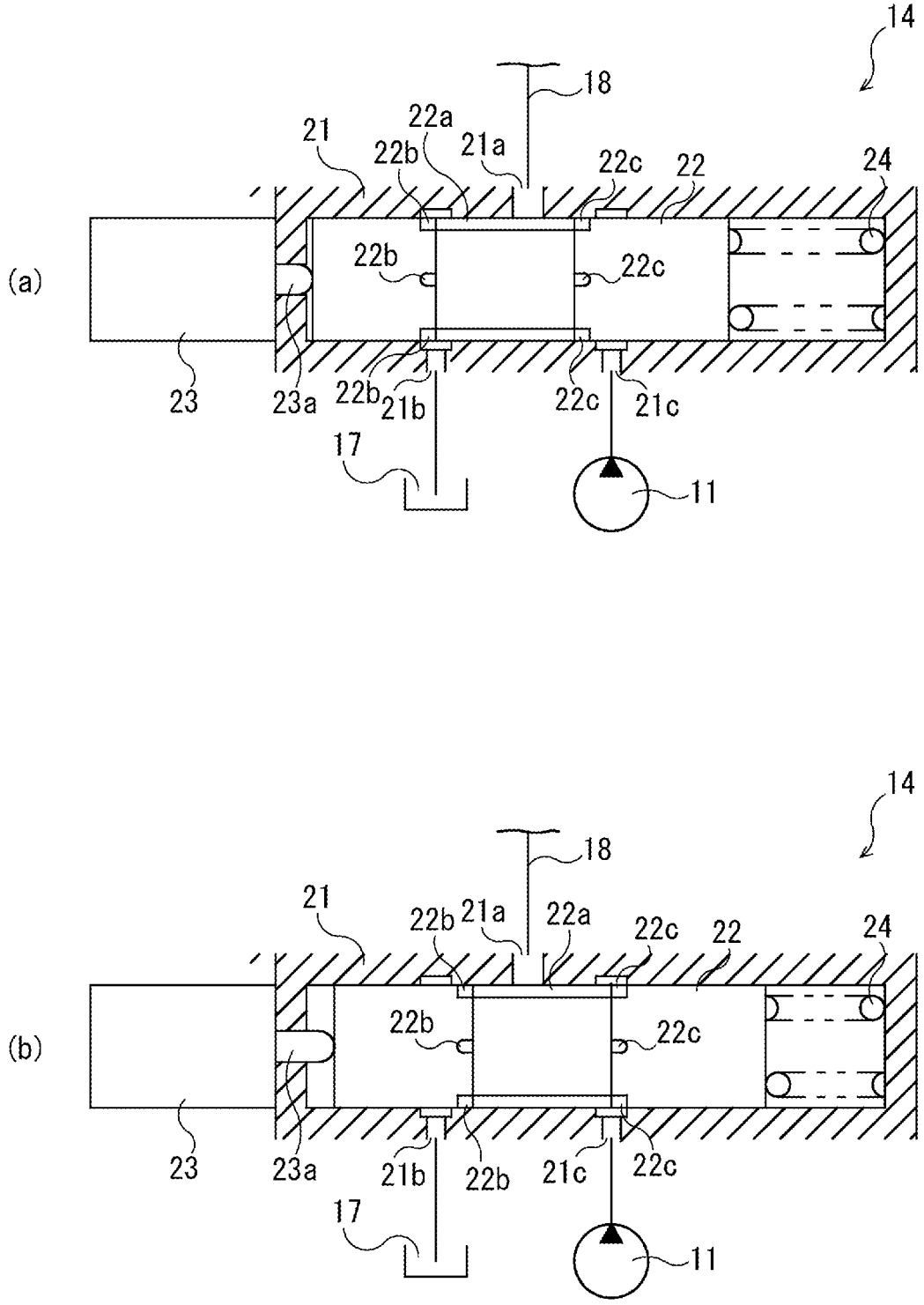
FIG. 2 is a cross-sectional view illustrating a solenoid switch valve included in the hydraulic system illustrated in FIG. 1.

The pilot pump 13 is a pump of the fixed capacitance (for example, a gear pump) and is driven to rotate by the engine E. The pilot pump 13 dispenses a predetermined amount of pilot oil to a pilot passage 18, and the safety lock valve 14 is located in the pilot passage 18. The safety lock valve 14, which is what is called a solenoid switch valve, can block the pilot passage 18. The safety lock valve 14 is configured as illustrated in FIG. 2, for example, and includes a housing 21, a spool 22, a solenoid 23, and a spring member 24. Note that FIG. 2 schematically illustrates the configuration of the safety lock valve 14 and is not intended to limit the configuration of the safety lock valve 14. The configuration of the safety lock valve 14 illustrated in FIG. 2 will be described below.

Three ports 21*a*, 21*b*, 21*c* are formed in the housing 21, which is one example of the first housing, and the three ports 21*a*, 21*b*, 21*c* are respectively connected to the pilot pump 13, the tank 17, and the two solenoid proportional pressure-reducing valves 15L, 15R to be described later. Furthermore, the spool 22 is housed in the housing 21 in such a manner that the spool 22 is slidable along the axial line thereof (in other words, the spool 22 can reciprocate), and the spool 22 can switch the connection state of each of the three ports 21*a*, 21*b*, 21*c* by changing the position of the spool 22. More specifically, the spool 22, which is one example of the first valve spool, includes a communication passage 22*a* in the shape of a circular ring. The communication passage 22*a* in the shape of a circular ring is formed by depressing an axially middle portion of the spool 22 in the entire perimeter, and is constantly connected to the third port 21*c*. Furthermore, the spool 22 includes a plurality of notches 22*b*, 22*c* in a round shoulder portion formed having a greater diameter than the axially middle portion. The notches 22*b*, 22*c* are open in the first port 21*a* and the second port 21*b*, respectively, depending on the position of the spool 22, and when the notches 22*b*, 22*c* are open, the ports 21*a*, 21*b* are connected to the third port 21*c* via the communication passage 22*a*. Specifically, it is possible to block and open the pilot passage 18 by moving the spool 22 (more specifically, moving the spool 22 to the block position illustrated in (a) in FIG. 2 and the open position illustrated in (b) in FIG. 2). In order to move the spool 22 which operates as just described, the solenoid 23 is provided thereon. Note that the plurality of notches 22*b*, 22*c* do not necessarily need to be formed.

The solenoid 23 generates a magnetic force according to a switching command (one example of the operation command) input thereto. A rod 23*a* of the solenoid 23 is in abutment with the spool 22 and moves the spool 22 to the open position by pushing the spool 22 with thrust corresponding to the magnetic force. Furthermore, the spring member 24 is provided on the spool 22, and the spool 22 receives, from the spring member 24, a biasing force against the magnetic force (thrust) of the solenoid 23, that is, toward the block position. Therefore, in the case where the magnetic force is less than the biasing force, the spool 22 moves to the block position or is held in the block position.

In the safety lock valve 14 configured as described above, the downstream end thereof is connected to the tank 17 by connecting the first port 21*a* to the second port 21*b* when the spool 22 is in the block position. On the other hand, when the spool 22 is moved to the open position, the first port 21*a* is connected to the third port 21*c*, the downstream end is connected to the pump 11, and the pilot oil is guided downstream of the safety lock valve 14. Furthermore, the pilot passage 18 branches into two passage portions 18L, 18R on the downstream side of the safety lock valve 14, and the solenoid proportion pressure-receiving valves 15L, 15R are connected to these two passage portions 18L, 18R, respectively, in order to provide the pilot pressures PL, PR to the spool 22.

The solenoid proportion pressure-receiving valves 15L, 15R reduce the pressure of the pilot oil to the secondary pressures (namely, the pilot pressures PL, PR) on the basis of a pressure-reducing command input to the solenoid proportion pressure-receiving valves 15L, 15R. The configurations of the solenoid proportional pressure-receiving valves 15L, 15R are similar to the configuration of the safety lock valve 14, for example, and the configuration thereof will be briefly described below. Since the solenoid proportional pressure-receiving valves 15L, 15R have the same configuration, only the elements of one of the solenoid proportional pressure-receiving valves 15L, 15R will be described, and the elements of the other will be assigned the same reference signs and description of the element will be omitted. Furthermore, as with the configuration of the safety lock valve 14, the configurations of the solenoid proportional pressure-receiving valves 15L, 15R described below are merely one example and are not limited thereto.

Figure 3:
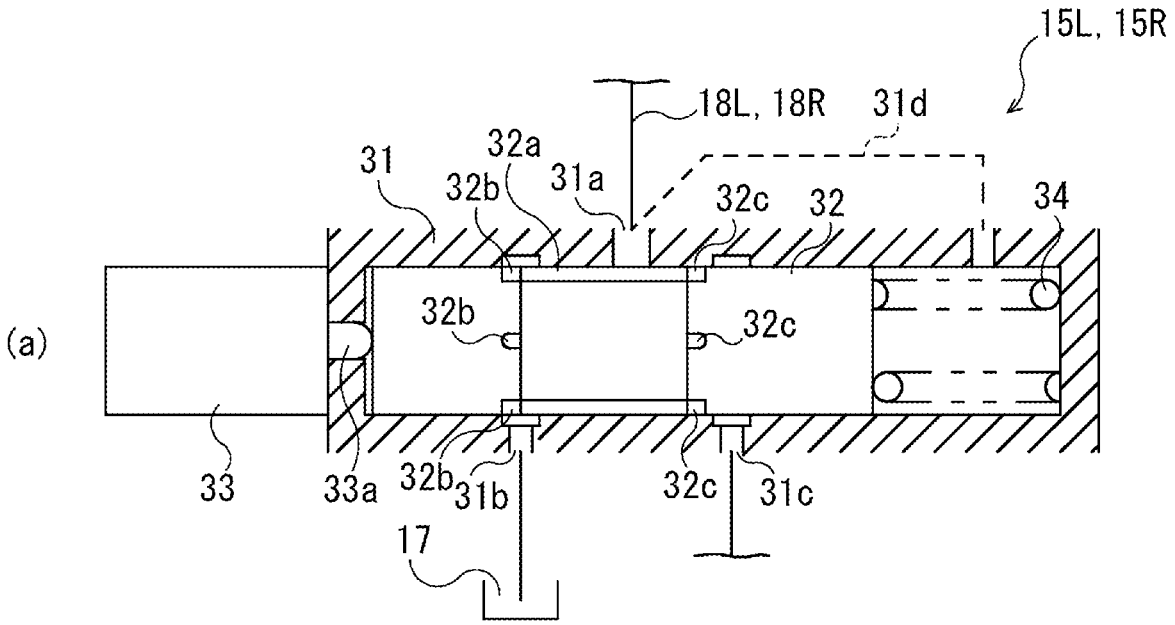
FIG. 3 is a cross-sectional view illustrating a solenoid proportional pressure-reducing valve included in the hydraulic system illustrated in FIG. 1.
Figure 3:
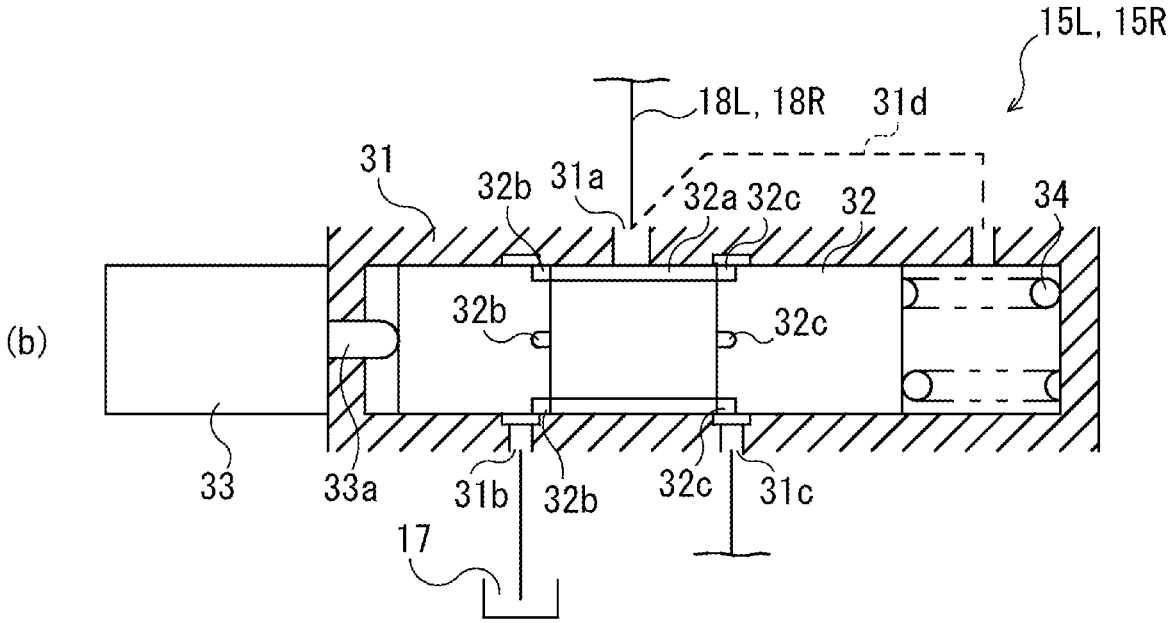

The first solenoid proportional pressure-reducing valve 15L includes a housing 31, a spool 32, a solenoid 33, and a spring member 34, as illustrated in FIG. 3. Three ports 31*a*, 31*b*, 31*c* are formed in the housing 31, which is one example of the second housing, and are connected to the safety lock valve 14, the tank 17, and the multi-control valve 12, respectively. Furthermore, the spool 32 is housed in the housing 31 in such a manner that the spool 32 is slidable along the axial line thereof (in other words, the spool 32 can reciprocate), and the spool 32 can switch the connection state of each of the three ports 31*a*, 31*b*, 31*c* by changing the position of the spool 32. Furthermore, a communication passage 32*a* and notches 32*b*, 32*c* are formed in the spool 32, which is one example of the second valve spool, the notches 32*b*, 32*c* are connected to the first port 31*a* and the second port 31*b* with the degree of opening corresponding to the position of the spool 32, and the first pilot pressure PL corresponding to the degree of opening is output through the third port 31*c*. This means that the first pilot pressure PL can be adjusted by moving the spool 32, and the solenoid 33 is provided on the spool 32 in order to make the adjustment.

The solenoid 33 generates a magnetic force corresponding to a pressure-reducing command (one example of the operation command) input thereto. A rod 33*a* of the solenoid 33 is in abutment with the spool 32 and moves the spool 32 by pushing the spool 32 with thrust corresponding to the magnetic force. In other words, the spool 32 can move from the full closed position in which the third port 31*c* is closed, in a direction to open the third port 31*c*, and also move to an opening position in which the third port 31*c* is open. Furthermore, the spring member 34 is provided on the spool 32, and the spool 32 receives, from the spring member 34, a biasing force against the magnetic force (thrust) of the solenoid 33. Furthermore, a feedback passage 31*d* is formed in the housing 31. The feedback passage 31*d* causes the secondary pressure (first pilot pressure PL) to return into the housing 31 and exerts the secondary pressure (first pilot pressure PL) on the spool 32 so as to oppose the magnetic force of the solenoid 33. Therefore, the spool 32 moves to a position in which the magnetic force, the biasing force, and the secondary pressure are balanced, and thus the first pilot pressure PL corresponding to the magnetic force (in other words, corresponding to the pressure-reducing command) can be output from the solenoid proportional pressure-reducing valve 15L. In this manner, the solenoid proportional pressure-reducing valves 15L, 15R can output the pilot pressures PL, PR corresponding to the pressure-reducing command; as illustrated in FIG. 1, each of the solenoid proportional pressure-reducing valves 15L, 15R is electrically connected to the control device 16 in order that the pressure-reducing command is input to the solenoid proportional pressure-reducing valve.

As mentioned earlier, the control device 16 is connected to each of the solenoid proportional pressure-reducing valves 15L, 15R, and outputs the pressure-reducing command (for example, an electric current) to each of the solenoid proportional pressure-reducing valves 15L, 15R. The pressure-reducing command, which is one example of the operation command, is, for example, a pulse-width modulation signal (in short, a PWM signal), and the solenoid proportional pressure-reducing valves 15L, 15R reduce the pilot pressures PL, PR to desired pressures by pressing the spool 32 with the magnetic force corresponding to the duty cycle of the PWM signal. Specifically, when a zero signal (predetermined command) at zero duty cycle is output from the control device 16, the spool 32 is placed in the full closed position, then the duty cycle is increased, for example, to increase the magnetic force, and thus the spool 32 can be moved toward the opening position.

Furthermore, the control device 16 is also electrically connected to the safety lock valve 14 and outputs a switching command to the safety lock valve 14. The switching command, which is one example of the operation command, is, for example, a step-wise command signal such as ON and OFF; when an ON signal (open command) of a predetermined electric current is output, the spool 22 moves to the full open position, and the solenoid proportional pressure-reducing valves 15L, 15R are connected to the pump 13. On the other hand, when the switch signal is an OFF signal (close command), the spool 22 returns to the full closed position, and the solenoid proportional pressure-reducing valves 15L, 15R are connected to the tank 17.

Furthermore, an operation device (not illustrated in the drawings) is connected to the control device 16 in order to input the amount of extension or retraction of the hydraulic cylinder 2. The operation device is, for example, an electric joystick or an operation valve and outputs, to the control device 16, an operation signal corresponding to the amount of operation (including the direction of operation) of an operation tool such as a lever provided on the electric joystick or the operation valve. On the basis of this operation signal, the control device 16 creates the pressure-reducing command and outputs the pressure-reducing command to the solenoid proportional pressure-reducing valves 15L, 15R. Furthermore, the operation device includes a safety lever, and when the safety lever is operated, the operation device outputs a lock signal to the control device 16. Accordingly, the control device 16 outputs a switch signal (specifically, an OFF signal with a zero electric current) to the safety lock valve 14 and causes the safety lock valve 14 to block the pilot passage 18. Note that the operation device that operates the safety lock valve 14 does not necessarily need to be a safety lever and may be a switch or the like.

Furthermore, three pressure sensors 19, 19L, 19R are electrically connected to the control device 16. The first pressure sensor 19 outputs, to the control device 16, a signal corresponding to the pressure of the pilot oil output from the safety lock valve 14. The second pressure sensor 19L and the third pressure sensor 19R output, to the control device 16, the secondary pressures of the solenoid proportional pressure-reducing valves 15L, 15R, specifically, signals corresponding to the pilot pressures PL, PR. Subsequently, the control device 16 detects hydraulic pressures on the basis of the signals received from the pressure sensors 19, 19L, 19R. Furthermore, the control device 16 can detect electric currents (or voltages) output on the basis of the commands provided to the safety lock valve 14 and the solenoid proportional pressure-reducing valves 15L, 15R, in other words, actual electric currents (or actual voltages).

When the operation tool of the operation device is operated in the state where the two pumps 11, 13 are driven by the engine E and the pilot passage 18 is open by the safety lock valve 14, the hydraulic system 1 configured as described above operates as follows. Specifically, the control device 16 outputs the pressure-reducing command to one of the two solenoid proportional pressure-reducing valves 15L, 15R according to the operation signal received from the operation device. For example, when the pressure-reducing command is input to the first solenoid proportional pressure-reducing valve 15L, the first pilot pressure PL is output from the first solenoid proportional pressure-reducing valve 15L, and the spool 12*a* moves to the first offset position A1. Thus, the hydraulic cylinder 2 is extended. On the other hand, when the pressure-reducing command is input to the second solenoid proportional pressure-reducing valve 15R, the second pilot pressure PR is output from the second solenoid proportional pressure-reducing valve 15R, and the spool 12*a* moves to the second offset position A2. Thus, the hydraulic cylinder 2 is retracted. Furthermore, when the safety lever is operated or when a malfunction or the like occurs, for example, the control device 16 outputs the switch signal (specifically, the OFF signal) to the safety lock valve 14 and causes the safety lock valve 14 to block the pilot passage 18. Therefore, regardless of the presence or absence of the operation signal from the operation device, the pilot pressures PL, PR from the solenoid proportional pressure-reducing valves 15L, 15R can be made zero. Thus, it is possible to keep the hydraulic cylinder 2 from operating when the safety lever is operated or when a malfunction or the like occurs, for example.

<Self-Cleaning Function>

The hydraulic system 1 configured as described above includes the following self-cleaning function. Specifically, in the hydraulic system 1, it is possible to remove contaminants caught in a gap between the spool 22 and the housing 21 and a gap between the spool 32 and the housing 31 or contaminants stuck in the opening portions such as the notches 22*b*, 22*c*, 32*b*, 32*c* (metering portions) in the safety lock valve 14 and the solenoid valves such as the solenoid proportional pressure-reducing valves 15L, 15R. In such a self-cleaning function, an ON or OFF signal that has been continuously input to, for example, the safety lock valve 14, is reversed into an OFF or ON signal for a first predetermined amount of time (for example, a short amount of time no more than 0.2 seconds) to reciprocate the spool 22. This allows the spool 22 to move from the full open position to the full closed position or from the full closed position to the full open position. This reciprocating movement enables the aforementioned contaminants to be scraped off and carried away to the communication passage 22*a*, for example, making it possible to actively remove a larger amount of contaminants attached to the outer peripheral surface of the spool 22. Thus, the sticking of the spool 22 and the failure to close the notches 22*b*, 22*c* due to the contaminants, for example, in other words, the occurrence of operational malfunctions, can be minimized. Furthermore, by reciprocating the spool 22, it is possible to coat the outer peripheral surface of the spool 22 with layers of the operating oil. This means that a wider range can be coated with layers of the pilot oil and the lubricity of the spool 22 can be increased. With this, it is possible to minimize a reduction in the responsiveness of the safety lock valve 14. Note that the control device 16 reciprocates the spool 22 only once in the present embodiment, but may reciprocate the spool 22 two or more times; it is sufficient that the control device 16 reciprocate the spool 22 at least once.

In the case of the solenoid proportional pressure-reducing valves 15L, 15R, the control device 16 changes a zero signal that has been continuously input into a specific pressure-reducing command, more specifically, a step-wise signal, for a second predetermined amount of time (for example, a short amount of time no more than 0.2 seconds) to reciprocate the spool 32 from the full closed position. Note that the spool 32 reciprocates in such a manner as to move from the full closed position to the full open position and return to the full closed position in the present embodiment, but may reciprocate in such a manner as to move from the full open position to the full closed position and return to the full open position. This reciprocating movement enables the aforementioned contaminants to be scraped off and carried away to the communication passage 32*a*, for example, making it possible to actively remove a larger amount of contaminants attached to the outer peripheral surface of the spool 32. Thus, the sticking of the spool 32 and the failure to close the notches 32*b*, 32*c* due to the contaminants, for example, in other words, the occurrence of operational malfunctions, can be minimized. Furthermore, by reciprocating the spool 32, it is possible to coat the outer peripheral surface of the spool 32 with layers of the operating oil. This means that a wider range can be coated with layers of the pilot oil and the lubricity of the spool 32 can be increased. With this, it is possible to minimize a reduction in the responsiveness of the solenoid proportional pressure-receiving valves 15L, 15R. Note that the present embodiment assumes that the spool 32 reciprocates more than once, but the number of times the spool 32 reciprocates may be one; it is sufficient that the spool 32 reciprocate at least once.

Figure 4:
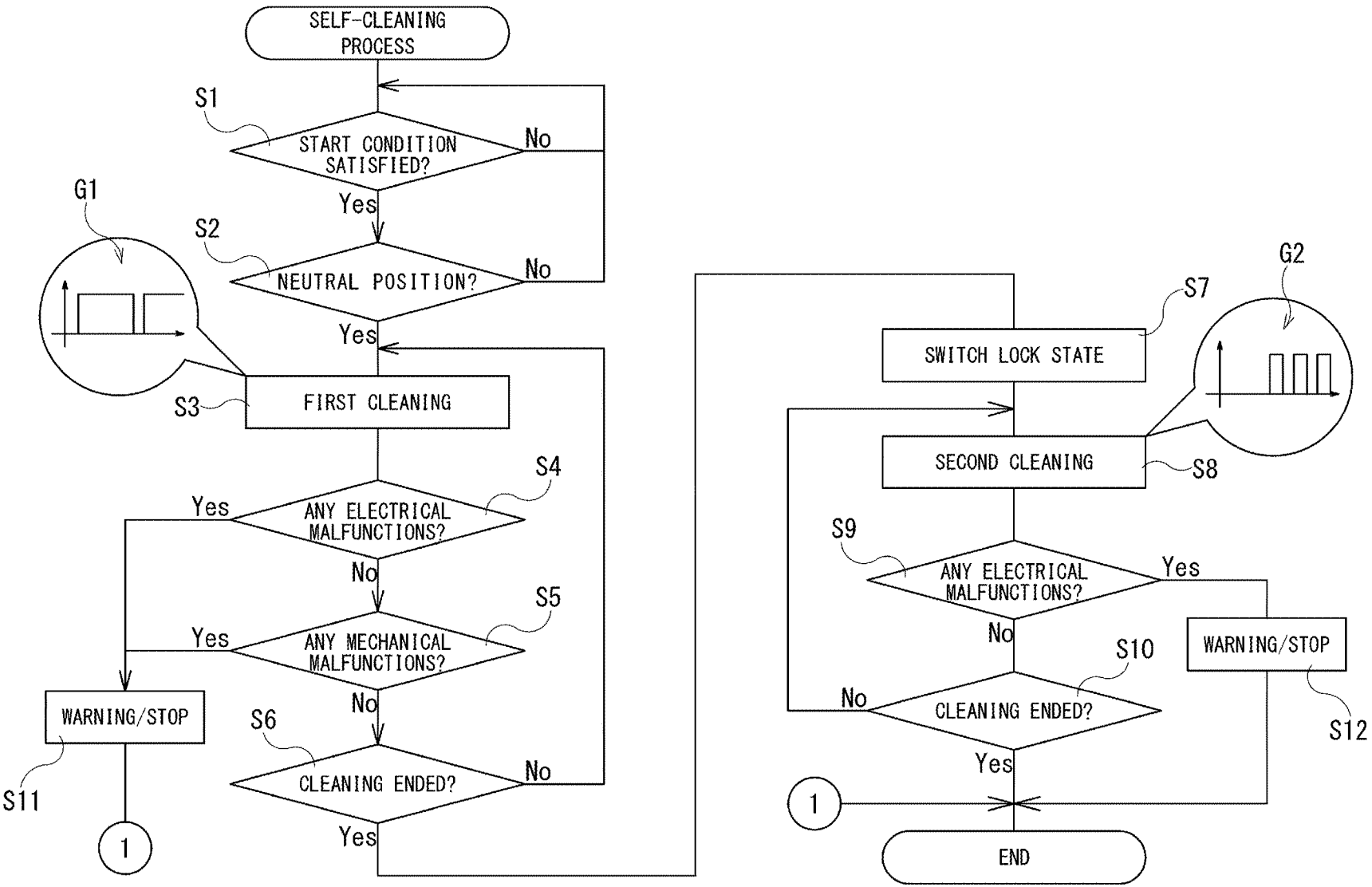
FIG. 4 is a flowchart illustrating the flow of a self-cleaning process that is performed by a hydraulic system according to Embodiment 1 of the present invention.

In the hydraulic system 1 including such a function, a self-cleaning process is performed in order to do cleaning by intentionally reciprocating the spools 22, 32 of the safety lock valve 14 and the solenoid proportional pressure-reducing valves 15L, 15R. Hereinafter, the self-cleaning process will be described with reference to FIG. 4. When electric power is supplied to the control device 16 (when a power switch or the like is turned ON), the self-cleaning process is started, and when the self-cleaning process is started, the processing transitions to Step S1. In Step S1 which is a start condition satisfaction determination step, the control device 16 determines whether or not a predetermined start condition is satisfied. The start condition includes, for example, a condition in which the engine E is not operating (in other words, the pilot pump 13 is not operating) and a condition in which the spool 22 of the safety lock valve 14 is in the block position; in the present embodiment, only the latter is the start condition. Note that the start condition does not necessarily need to be one of these two conditions and may be a simple condition in which the control device 16 is being supplied with electric power. The control device 16 determines, on the basis of the switch signal output to the safety lock valve 14, whether or not the start condition is satisfied, and when the control device 16 determines that the start condition is not satisfied, the control device 16 repeats the determination in Step S1. On the other hand, when the control device 16 determines that the start condition is satisfied, the processing transitions to Step S2.

In Step S2 which is a neutral position determination step, the control device 16 determines whether or not the position of the spool 12*a* of the multi-control valve 12 is a neutral position M. More specifically, since the biasing forces of the two spring members 12L, 12R act on the spool 12*a* toward each other, the spool 12*a* is held in the neutral position M when the pilot pressures PL, PR are less than a predetermined pressure value. In other words, the spool 12*a* includes a dead band in which the spool 12*a* does not operate when the pilot pressures PL, PR are less than the predetermined pressure value, and when the pressure-reducing command output to the solenoid proportional pressure-receiving valves 15L, 15R is less than a predetermined value, the spool 12*a* is held in the neutral position M. Therefore, the control device 16 determines whether or not the pressure-reducing command to be output from the control device 16 is less than the predetermined value (in other words, whether or not the absolute value of the amount of operation of the operation device is less than a predetermined amount) (whether or not the first condition is satisfied). When the pressure-reducing command is greater than or equal to the predetermined value, if the spool 22 of the safety lock valve 14 reciprocates, the position of the spool 22 may change; therefore, it is determined that the first condition is not satisfied, and the processing returns to Step S1. On the other hand, when the pressure-reducing command is less than the predetermined value, it is determined that the first condition is satisfied, and the processing transitions to Step S3.

In Step S3 which is a first cleaning step, the switching command to be output by the control device 16 is reversed for the first predetermined amount of time to reciprocate the spool 22 from the full closed position. Specifically, in the state where the control device 16 outputs the OFF signal, the control device 16 outputs the ON signal (refer to the reference sign G1 in FIG. 4) for the first predetermined amount of time to reciprocate the spool 22 from the full closed position. Note that the control device 16 may continuously output the ON signal and for the first predetermined amount of time, reverse the ON signal into the OFF signal to reciprocate the spool 22 from the full open position. Reciprocating the spool 22 in this manner makes it possible to minimize the occurrence of operational malfunctions due to contaminants in the safety lock valve 14 and allows the spool 22 to move smoothly. When the cleaning task for the safety lock valve 14 is started in this manner, the processing transitions to Step S4.

In Step S4 which is an electrical malfunction determination step, the control device 16 determines the presence or absence of an electrical malfunction in the safety lock valve 14 on the basis of the switching command output from the control device 16. Specifically, the control device 16 detects an actual electric current (or an actual voltage) corresponding to the switching command output in Step S3 and compares the switching command and the actual electric current (or the actual voltage). The control device 16 determines whether or not these are completely different (for example, in the present embodiment, whether or not the actual electric current (or the actual voltage) is zero or approximately zero in response to the ON signal or whether or not the actual electric current (or the actual voltage) is different from zero in response to the OFF signal). When these are completely different, it is determined that there are electrical malfunctions such as wire breakage and a short circuit between the control device 16 and the safety lock valve 14. When it is determined that there is an electrical malfunction, the processing transitions to Step S11. In Step S11 which is a warning/stop step, using a warning device (for example, a light-emitting diode (LED) or a display) not illustrated in the drawings, the control device 16 provides a warning to the effect that there is an electrical malfunction, and sets the switching command to the OFF signal. The self-cleaning process is then ended. On the other hand, when those are the same, it is determined that there are no electrical malfunctions, and the processing transitions to Step S5.

In Step S5 which is a mechanical malfunction determination step, the control device 16 determines the absence or presence of a mechanical malfunction in the safety lock valve 14 on the basis of the switching command output from the control device 16 and the pressure signal from the first pressure sensor 19. For example, the control device 16 detects, on the basis of the pressure signal from the pressure sensor 19, the pressure output from the safety lock valve 14, and determines the presence or absence of a mechanical malfunction on the basis of the detected pressure and the switching command. Specifically, when the detected pressure is greater than or equal to a predetermined pressure even while the OFF signal is output, the control device 16 determines that there is a mechanical malfunction such as the sticking of the spool 22 of the safety lock valve 14. Similarly, when the detected pressure is less than the predetermined pressure even while the ON signal is output, it is determined that there is a mechanical malfunction such as the sticking of the spool 22 of the safety lock valve 14. Thus, when the detected pressure does not correspond to the switching command, it is determined that there is a mechanical malfunction. In this case, the processing transitions to Step S11. In Step S11 which is a warning/stop step, using a warning device (for example, a light-emitting diode (LED) or a display) not illustrated in the drawings, the control device 16 provides a warning to the effect that there is a mechanical malfunction. Furthermore, the control device 16 maintains, at zero, the pressure-reducing command to be output to the solenoid proportional pressure-reducing valves 15L, 15R, in order to prevent the spool 12*a* of the multi-control valve 12 from making undesired movement. The self-cleaning process is then ended. On the other hand, when the pressure detected by the control device 16 corresponds to the switching command, it is determined that there are no mechanical malfunctions, and the processing transitions to Step S6.

In Step S6 which is a cleaning end determination step, the control device 16 determines whether or not to end the cleaning task for the safety lock valve 14. More specifically, the control device 16 determines whether or not a first end condition is satisfied. The first end condition is, for example, a condition in which the spool 22 has reciprocated a predetermined number of times (in other words, the ON signal and the OFF signal have been switched a predetermined number of times) or a condition in which a predetermined time has elapsed since the start of the reciprocating movement of the spool 22. Note that in the present embodiment, the predetermined number of times is one. When it is determined that the first end condition is not satisfied, the processing returns to Step S3, and the cleaning continues. On the other hand, when it is determined that the first end condition is satisfied, the cleaning for the safety lock valve 14 is ended. When the cleaning is ended, the processing transitions to Step S7 in order to clean the solenoid proportional pressure-reducing valves 15L, 15R.

In Step S7 which is a lock state switching state, the control device 16 blocks the pilot passage 18. Specifically, the control device 16 outputs the OFF signal and moves the spool 22 of the safety lock valve 14 to the block position. Accordingly, the second condition in which the pilot passage 18 is blocked is satisfied, and the processing transitions to Step S8.

In Step S8 which is a second cleaning step, the control device 16 outputs a specific pressure-reducing command to each of the solenoid proportional pressure-reducing valves 15L, 15R to reciprocate the spool 32 from the full closed position. For example, in the state where a zero signal is continuously output, the control device 16 changes the zero signal into the specific pressure-reducing command, for example, a step-wise signal, to reciprocate the spool 32 from the full closed position. This makes it possible to minimize the occurrence of operational malfunctions due to contaminants in the solenoid proportional pressure-reducing valves 15L, 15R and allows the spool 32 to move smoothly. When the cleaning task for the solenoid proportional pressure-reducing valves 15L, 15R is started in this manner, the processing transitions to Step S9.

In Step S9 which is an electrical malfunction determination step, the control device 16 determines the presence or absence of an electrical malfunction in the solenoid proportional pressure-reducing valves 15L, 15R on the basis of the pressure-reducing command output from the control device 16. Specifically, as in Step S4, the control device 16 detects an actual electric current (or an actual voltage) corresponding to the pressure-reducing command output in Step S7, calculates a deviation between the pressure-reducing command and the actual electric current (or the actual voltage), and determines whether or not the deviation is within a predetermined range. When the deviation is not within the predetermined range, it is determined that there are electrical malfunctions such as wire breakage and a short circuit between the control device 16 and the solenoid proportional pressure-reducing valves 15L, 15R. When it is determined that there is an electrical malfunction, the processing transitions to Step S12. In Step S12 which is a warning/stop step, using a warning device (for example, a light-emitting diode (LED) or a display) not illustrated in the drawings, the control device 16 provides a warning to the effect that there is an electrical malfunction, and sets the pressure-reducing command to zero. The self-cleaning process is then ended. On the other hand, when the deviation is within the predetermined range, it is determined that there are no electrical malfunctions. When it is determined that there are no electrical malfunctions, the processing transitions to Step S10.

In Step S10 which is a cleaning end determination step, the control device 16 determines whether or not to end the cleaning task for the solenoid proportional pressure-reducing valves 15L, 15R. Specifically, the control device 16 determines whether or not a second end condition is satisfied. The second end condition is, for example, a condition in which the spool 32 has reciprocated a predetermined number of times (specifically, at least once) (in other words, ON and OFF in the step-wise pressure-reducing command are repeated a predetermined number of times) or a condition in which a predetermined time has elapsed since the start of the reciprocating movement of the spool 32. When it is determined that the second end condition is not satisfied, the processing returns to Step S8, and the cleaning continues. On the other hand, when it is determined that the second end condition is satisfied, the control device 16 ends the cleaning. Thus, the self-cleaning process is ended.

In the hydraulic system 1 configured as described above, in the self-cleaning process, the switch signal to be output is reversed for the first predetermined amount of time (or the specific pressure-reducing signal is output) to reciprocate the spool 22 of the safety lock valve 14 (or the spool 32 of each of the solenoid proportional pressure-reducing valves 15L, 15R) from the full closed position. Therefore, the step-wise switch signal (or pressure-reducing signal) can be output and a greater magnetic force can be generated, and thus it is possible to move the spool 22 (or the spool 32) even when some contaminants stick thereto. This makes it possible to achieve higher cleaning effects. Note that the switch signal and the pressure-reducing signal are preferably signals that change stepwise, but do not necessarily need to be such signals and may be sweep signals that gradually increase and decrease; the switch signal and the pressure-reducing signal can be any signals that can cause the reciprocating movement.

Furthermore, in the hydraulic system 1, the cleaning task is performed on the spool 22 of the safety lock valve 14 in the state where the spool 12*a* of the multi-control valve 12 is maintained in the neutral position M, and the cleaning task is performed on the solenoid proportional pressure-receiving valves 15L, 15R in the state where the pilot passage 18 is blocked. Therefore, during the cleaning and during the determination in the case where there is an electrical malfunction or a mechanical malfunction, undesired movement of the hydraulic cylinder 2 that results from an unintentional influx of the operating oil into the hydraulic cylinder 2 can be minimized. Note that substantially the same advantageous effects can be obtained when the driving of the engine E is stopped, in other words, the driving of the pilot pump 13 is stopped, in the hydraulic system 1.

Embodiment 2

A hydraulic system 1A according to Embodiment 2 has the same configuration as the hydraulic system 1 according to Embodiment 1, as illustrated in FIG. 1. However, a self-cleaning process which the hydraulic system 1A performs is somewhat different from the self-cleaning which the hydraulic system 1 performs. Hereinafter, the self-cleaning process which the hydraulic system 1A performs will be described focusing on differences from the self-cleaning process which the hydraulic system 1 performs. Note that elements of the hydraulic system 1A according to Embodiment 2 are assigned the same reference signs as those of the hydraulic system 1 according to Embodiment 1 and as such, description of the elements will be omitted.

Figure 5:
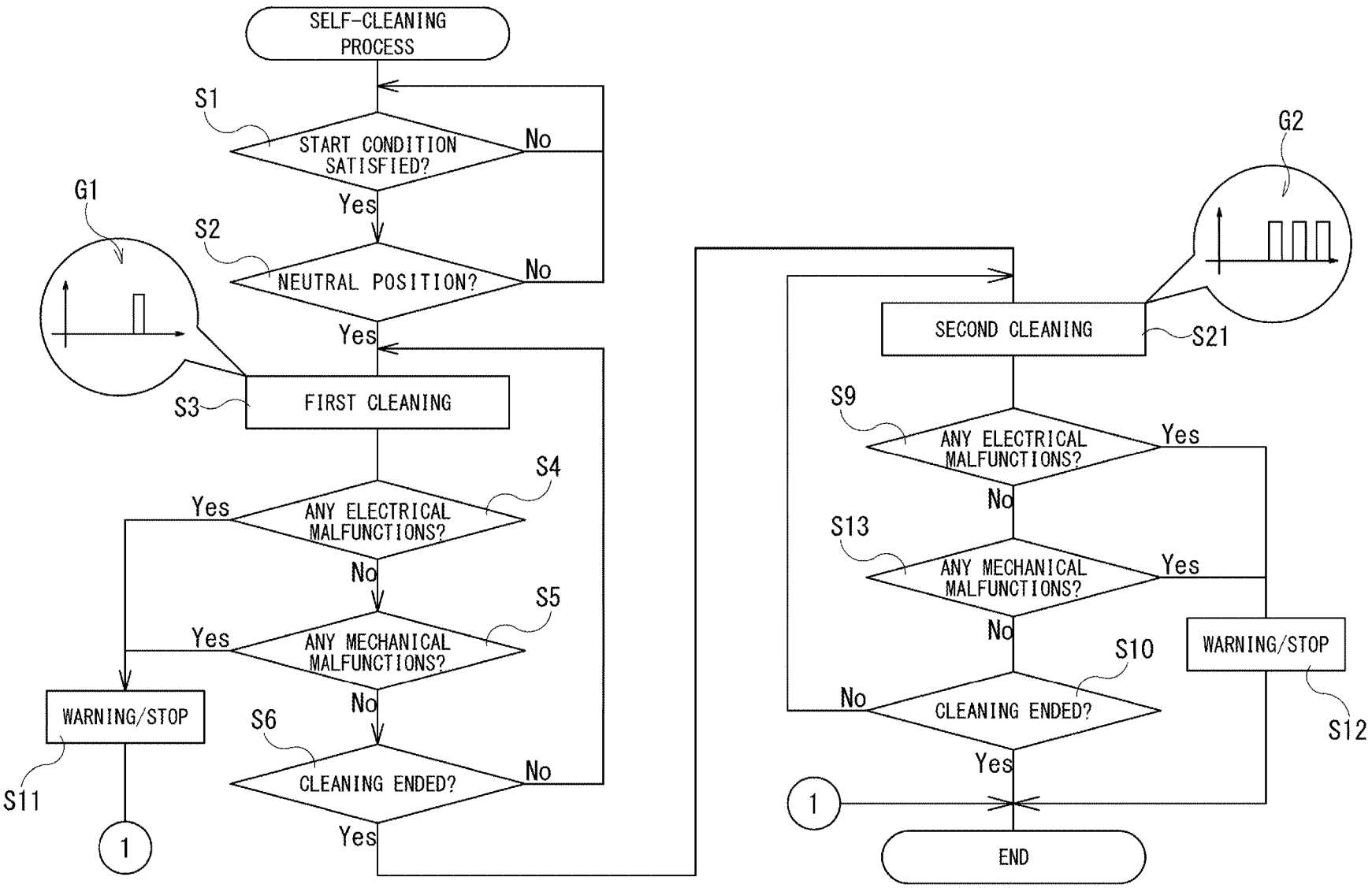
FIG. 5 is a flowchart illustrating the flow of a self-cleaning process that is performed by a hydraulic system according to Embodiment 2 of the present invention.

In the self-cleaning process which the hydraulic system 1A performs, when it is determined that the second end condition is satisfied and the cleaning is ended in Step S6, the processing transitions to Step S21, as illustrated in FIG. 5. In Step S21 which is a second cleaning step, the control device 16 outputs a specific pressure-reducing command to each of the solenoid proportional pressure-reducing valves 15L, 15R to reciprocate the spool 32 from the full closed position. Specifically, in the state where the zero signal is continuously output, the control device 16 changes the PWM signal into a specific pressure-reducing signal, for example, a step-wise signal or a sweep signal, to reciprocate the spool 32 from the full closed position. At this time, the control device 16 outputs pressure-reducing commands with the same or substantially the same electric currents (or voltages) to the solenoid proportional pressure-reducing valves 15L, 15R at the same time. Thus, the pilot pressures PL, PR at the same or substantially same levels can be output from the solenoid proportional pressure-reducing valves 15L, 15R, and the spool 32 of each of the two solenoid proportional pressure-reducing valves 15L, 15R can reciprocate from the full closed position (in other words, the cleaning can be performed) in the state where the spool 12*a* of the multi-control valve 12 is maintained in the neutral position M. When the cleaning task is performed on the spool 32 in this manner, the processing transitions to Step S9. Furthermore, when it is determined in Step S9 that there are no electrical malfunctions, the processing transitions to Step S13.

In Step S13 which is a mechanical malfunction determination step, the control device 16 determines the absence or presence of a mechanical malfunction in the solenoid proportional pressure-receiving valves 15L, 15R on the basis of the pressure-reducing command output from the control device 16 and the pressure signals from the second and third pressure sensors 19L, 19R. For example, the control device 16 detects the first pilot pressure PL on the basis of the pressure signal from the second pressure sensor 19L and determines the absence or presence of a mechanical malfunction on the basis of the detected first pilot pressure PL and the pressure-reducing command. In other words, when the pilot pressures PL, PR corresponding to the pressure-reducing command are not detected, it is determined that there is a mechanical malfunction in the solenoid proportional pressure-reducing valves 15L, 15R. In this case, the processing transitions to Step S11. In Step S11 which is a warning/stop step, using a warning device (for example, a light-emitting diode (LED) or a display) not illustrated in the drawings, the control device 16 provides a warning to the effect that there is a mechanical malfunction. Furthermore, in order to prevent the spool 12*a* of the multi-control valve 12 from making undesired movement, the control device 16 controls the movement of the solenoid proportional pressure-reducing valves 15L, 15R as follows.

Specifically, the control device 16 sets and outputs the pressure-receiving command so as to cause one of the solenoid proportional pressure-reducing valves 15R, 15L that has no mechanical malfunctions to output the same pilot pressure PL, PR as the pilot pressure PR, PL that is output from one of the solenoid proportional pressure-reducing valves 15R, 15L that has the mechanical malfunction. Thus, the spool 12*a* of the multi-control valve 12 can be returned to the neutral position M and maintained therein, and it is possible to minimize undesired movement of the hydraulic cylinder 2. When such a stop task is ended, the self-cleaning process is ended. On the other hand, when the pilot pressures PL, PR corresponding to the pressure-reducing command are detected, the control device 16 determines that there are no mechanical malfunctions, and the processing transitions to Step S10.

In the hydraulic system 1A configured as described above, it is possible to clean the pair of solenoid proportional pressure-reducing valves 15L, 15R without moving the spool 12*a* of the multi-control valve 12. In other words, it is possible to clean the solenoid proportional pressure-reducing valves 15L, 15R without blocking the pilot passage 18, meaning that the step for blocking the pilot passage 18 can be omitted. Aside from this, the hydraulic system 1A can produce substantially the same advantageous effects as the hydraulic system 1 according to Embodiment 1.

Other Embodiments

In the hydraulic systems 1, 1A according to Embodiments 1 and 2, the solenoid valves are the safety lock valve 14 and the solenoid proportional pressure-reducing valves 15L, 15R, but this is not limiting. For example, the solenoid valve may be a solenoid relief valve; the self-cleaning process can be performed with any valve that is configured so that the spool thereof moves by a solenoid.

In the hydraulic systems 1, 1A according to Embodiments 1, 1A, electrical and mechanical malfunctions in the solenoid valves 14, 15L, 15R are determined at the same time as the cleaning task, but these malfunctions may be determined separately from the cleaning task. In this case, it is sufficient that the control device 16 output the switching command and the pressure-reducing command with such a low electric current that the spools 22, 32 do not move. Furthermore, the safety lock valve 14 in the hydraulic systems 1, 1A according to Embodiments 1, 2 does not necessarily need to be controlled by the control device 16. This means that the safety lock valve 14 may be configured to allow direct operation thereof using a switch, a safety lever, or the like. In this case, although the safety lock valve 14 cannot be cleaned, it is possible to clean the two solenoid proportional pressure-reducing valves 15L, 15R by providing such a configuration that the two solenoid proportional pressure-reducing valves 15L, 15R output the pilot pressures PL, PR having the same value as in the hydraulic system 1A according to Embodiment 2. Furthermore, by enabling the control device 16 to check according to the pressure detected by the pressure sensor 19 that the pilot passage 18 is blocked by the safety lock valve 14, it is possible to clean the two solenoid proportional pressure-reducing valves 15L, 15R in substantially the same method as in the hydraulic system according to Embodiment 1.

Furthermore, in the hydraulic systems 1, 1A according to Embodiments 1, 2, when the power switch or the like is turned ON or immediately after the engine E starts, the self-cleaning process is performed, but the self-cleaning process does not necessarily need to be performed on the basis of such a condition. For example, the self-cleaning process may be performed when the start condition is satisfied, not immediately after the power switch or the like is turned ON or immediately after the engine E starts, but after some time has elapsed since the start. In this case, after the self-cleaning process is performed, the processing transitions to Step S2 instead of Step S1. Alternatively, turning OFF the power switch or the like may be set as a condition so that when this condition is satisfied, the self-cleaning process is performed. Specifically, the self-cleaning process may be performed by continuously supplying electric power to the control device 16 even after the power switch or the like is turned OFF, but stopping the supply of electric power to the control device 16 after the self-cleaning process is performed. As yet another example, the self-cleaning process may be performed by supplying electric power to the control device 16 regularly or by remote control while the hydraulic excavator is parked.

Furthermore, in the self-cleaning process, the cleaning task for the spool 22 of the safety lock valve 14 is performed earlier than the cleaning task for the spool 32 of each of the solenoid proportional pressure-reducing valves 15L, 15R, but the temporal order of these cleaning tasks is not necessarily limited to the stated order. Specifically, in the self-cleaning process, the cleaning task for the spool 32 of each of the solenoid proportional pressure-reducing valves 15L, 15R may be performed earlier than the cleaning task for the spool 22 of the safety lock valve 14.

Furthermore, in the hydraulic system 1A according to Embodiment 2, the same pressure-reducing command is output to each of the solenoid proportional pressure-reducing valves 15L, 15R in Step S21, but it is not always necessary that such a specific pressure-reducing command be output. Specifically, specific pressure-reducing commands to set the secondary pressures, at which the spool 12*a* of the multi-control valve 12 does not operate, less than a predetermined pressure value may be output to the solenoid proportional pressure-reducing valves 15L, 15R. This makes it possible to reciprocate the spool 32 of each of the solenoid proportional pressure-reducing valves 15L, 15R from the full closed position without moving the spool 12*a* of the multi-control valve 12. Thus, it is possible to produce substantially the same advantageous effects as the hydraulic system 1A according to Embodiment 2. Note that in this case, the pressure-reducing commands do not necessarily need to be output to the solenoid proportional pressure-reducing valves 15L, 15R at the same time. Furthermore, specific pressure-reducing commands to set the secondary pressures, at which the spool 12*a* of the multi-control valve 12 does not operate, less than a predetermined pressure value may be output to the solenoid proportional pressure-reducing valves 15L, 15R during the reciprocating movement of the spool 22 of the safety lock valve 14. Thus, it is possible to reciprocate the spool 22 of the safety lock valve 14 without moving the spool 12*a* of the multi-control valve 12, and undesired movement of the spool 12*a* during the reciprocating movement can be minimized.

From the foregoing description, many modifications and other embodiments of the present invention would be obvious to a person having ordinary skill in the art. Therefore, the foregoing description should be interpreted only as an example and is provided for the purpose of teaching the best mode for carrying out the present invention to a person having ordinary skill in the art. Substantial changes in details of the structures and/or functions of the present invention are possible within the spirit of the present invention.

REFERENCE CHARACTERS LIST

1, 1A hydraulic system
2 hydraulic cylinder (hydraulic actuator)

12 multi-control valve (control valve)
12*a* spool (control spool)
13 pilot pump
14 safety lock valve (solenoid valve, switch valve)
15L first solenoid proportional pressure-reducing valve (solenoid valve)
15R second solenoid proportional pressure-reducing valve (solenoid valve)
16 control device
18 pilot passage
19, 19L, 19R pressure sensor
21 housing (first housing)
22 spool (first valve spool)
31 housing (second housing)
32 spool (second valve spool)

The invention claimed is:

1. A hydraulic system, comprising:

a pair of solenoid valves, each of which includes a valve spool configured to slide within a housing and moves the valve spool according to an operation command input to the solenoid valve; and a control device that outputs the operation command to the solenoid valve, and, when a condition predetermined is satisfied, the control device outputs the operation command to the pair of solenoid valves to reciprocate the respective valve spool from a full open position or a full closed position wherein:

the pair of solenoid valves are a pair of solenoid proportional pressure-reducing valves and are disposed to exert secondary pressures output from the pair of solenoid valves on a control spool of a control valve toward each other;

the operation command includes a predetermined command to place each valve spool in the full open position or the full closed position; and when the condition is satisfied, the control device changes the predetermined command to be continuously output to each of the pair of solenoid proportional pressure-reducing valves into a specific operation command for a predetermined amount of time, equalizes the secondary pressures at the pair of solenoid proportional pressure-reducing valves, and reciprocates each valve spool.

2. The hydraulic system according to claim 1, further comprising:

a switch valve provided upstream of each of the pair of solenoid proportional pressure-reducing valves and capable of blocking a flow of operating oil directed to the solenoid valves, wherein:

the condition includes a condition in which the flow of the operating oil directed to the solenoid valves is blocked by the switch valve.

3. The hydraulic system according to claim 1, wherein:

the control device outputs a step-wise operation command to each of the pair of solenoid proportional pressure-reducing valves to reciprocate the respective valve spool.

4. The hydraulic system according to claim 1, wherein:

the condition includes a condition in which a hydraulic pressure is kept from flowing downstream of the solenoid valves.

5. The hydraulic system according to claim 1, further comprising:

a pressure sensor provided downstream of each of the pair of solenoid valves, wherein:

the control device detects an operational malfunction of the respective valve spool on the basis of a pressure detected by the pressure sensor and the operation command that is output to each of the pair of solenoid valves.

6. A hydraulic system, comprising a solenoid valve that includes a valve spool configured to slide within a housing, and moves the valve spool according to an operation command input to the solenoid valve; and a control device that outputs the operation command to the solenoid valve, and, when a condition predetermined is satisfied, the control device outputs the operation command to the solenoid valve to reciprocate the valve spool from a full open position or a full closed position, wherein:

the solenoid valve is a solenoid proportional pressure-reducing valve and is disposed to exert a secondary pressure output from the solenoid proportional pressure-reducing valve on a control spool of a control valve;

the control valve includes a dead band in which the control valve does not operate when the secondary pressure is less than a predetermined value; and the control device adjusts the operation command that is output to reciprocate the valve spool, to make the secondary pressure to be output from the solenoid proportional pressure-reducing valve less than the predetermined value.

7. A hydraulic system, comprising:

a pilot pump that dispenses pilot oil;

a pair of solenoid proportional pressure-reducing valves, each connected to the pilot pump via a pilot passage and configured to output a secondary pressure corresponding to a pressure-reducing command input to each of the pair of solenoid proportional pressure-reducing valves;

a control valve that controls, according to the secondary pressure output from each of the pair of solenoid proportional pressure-reducing valves, a flow of pressure oil flowing to a hydraulic actuator;

a solenoid switch valve provided in the pilot passage and configured to block the pilot passage according to a switching command input to the solenoid switch valve; and a control device that outputs the pressure-reducing command to each of the pair of solenoid proportional pressure-reducing valves and outputs the switching command to the solenoid switch valve, wherein:

the control valve includes a control spool and controls, according to a position of the control spool, the flow of the pressure oil flowing to the hydraulic actuator;

the solenoid switch valve includes a first valve spool configured to slide within a first housing, and blocks the pilot passage by moving the first valve spool according to the switching command input to the solenoid switch valve;

each of the pair of solenoid proportional pressure-reducing valves includes a second valve spool configured to slide within a second housing, adjusts the secondary pressure to be output, by moving the respective second valve spool according to the pressure-reducing command input to each of the pair of solenoid proportional pressure-reducing valves, and moves the control spool by exerting secondary pressures output from each of the pair of solenoid proportional pressure-reducing valves on the control spool toward each other;

the switching command includes an open command to place the first valve spool in a full open position and a close command to place the first valve spool in a full closed position;

the pressure-reducing command includes a predetermined command to place the respective second valve spool in the full open position or the full closed position; and when a first condition predetermined is satisfied, the control device outputs the switching command to the solenoid switch valve to reverse an operation command that is one of the open command and the close command to be continuously output to the solenoid switch valve into the other operation command for a first predetermined short amount of time, and reciprocate the first valve spool from the full open position or the full closed position, and when a second condition predetermined is satisfied, the control device outputs the pressure-reducing command to the pair of solenoid proportional pressure-reducing valves to change the predetermined command to be continuously output to each of the pair of solenoid proportional pressure-reducing valves into a specific pressure-reducing command for a second predetermined amount of time, equalizes the secondary pressures at the pair of solenoid proportional pressure-reducing valves, and reciprocate the respective second valve spool from a full open position or a full closed position.

8. The hydraulic system according to claim 7, wherein:

at least one of the first condition and the second condition includes a condition in which the pilot pump is not operating.

9. A hydraulic system, comprising a pilot pump that dispenses pilot oil;

a solenoid proportional pressure-reducing valve connected to the pilot pump via a pilot passage and configured to output a secondary pressure corresponding to a pressure-reducing command input to the solenoid proportional pressure-reducing valve:

a control valve that controls, according to the secondary pressure output from the solenoid proportional pressure-reducing valve, a flow of pressure oil flowing to a hydraulic actuator;

a solenoid switch valve provided in the pilot passage and configured to block the pilot passage according to a switching command input to the solenoid switch valve; and a control device that outputs the pressure-reducing command to the solenoid proportional pressure-reducing valve and outputs the switching command to the solenoid switch valve, wherein:

the solenoid switch valve includes a first valve spool configured to slide within a first housing, and blocks the pilot passage by moving the first valve spool according to the switching command input to the solenoid switch valve;

the solenoid proportional pressure-reducing valve includes a second valve spool configured to slide within a second housing, and adjusts the secondary pressure to be output, by moving the second valve spool according to the pressure-reducing command input to the solenoid proportional pressure-reducing valve;

when a first condition predetermined is satisfied, the control device outputs the switching command to the solenoid switch valve to reciprocate the first valve spool from a full open position or a full closed position, and when a second condition predetermined is satisfied, the control device outputs the pressure-reducing command to the solenoid proportional pressure-reducing valve to reciprocate the second valve spool from the full open position or the full closed position;

the control valve includes a dead band in which the control valve does not operate when the secondary pressure is less than a predetermined value; and the first condition includes a condition in which the pressure-reducing command to make the secondary pressure to be output from the solenoid proportional pressure-reducing valve less than the predetermined value has been output.

* * * * *